US007445499B2

(12) United States Patent
Nunokawa et al.

(10) Patent No.: US 7,445,499 B2
(45) Date of Patent: Nov. 4, 2008

(54) PRESS-FIT CONTACT

(75) Inventors: Chiharu Nunokawa, Tokyo (JP); Satoshi Iijima, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/892,370

(22) Filed: Aug. 22, 2007

(65) Prior Publication Data

US 2008/0050946 A1 Feb. 28, 2008

(30) Foreign Application Priority Data

Aug. 25, 2006 (JP) ..... 2006-229060

(51) Int. Cl.
*H01R 13/60* (2006.01)

(52) U.S. Cl. ..... 439/567; 439/82

(58) Field of Classification Search ..... 439/82, 439/567

See application file for complete search history.

(56) References Cited

U.S. PATENT DOCUMENTS 4,381,134 A * 4/1983 Anselmo et al. ..... 439/444
4,475,780 A * 10/1984 Walter et al. ..... 439/82
4,735,575 A * 4/1988 Shaffer ..... 439/82
4,828,514 A * 5/1989 Johnson et al. ..... 439/751
5,564,954 A * 10/1996 Wurster ..... 439/751
5,944,538 A * 8/1999 Sorig ..... 439/82

FOREIGN PATENT DOCUMENTS

JP 2005-158507 6/2005

* cited by examiner

*Primary Examiner*—Truc T Nguyen
(74) *Attorney, Agent, or Firm*—Wenderoth, Lind & Ponack, L.L.P.

(57) ABSTRACT

To prevent damage to a printed circuit board due to concentration of contact pressure during press-fitting of press-fit contacts into through-holes of the board with narrow pitches, a press-fit contact includes a bulge portion formed wide substantially at a center in a long direction thereof, a press-fit portion extending from one end of the bulge portion and projecting in an arc in a width direction of the press-fit contact, a contact portion extending from the other end of the bulge portion, and an introduction portion extending from a distal end of the press-fit portion. A center portion of the press-fit portion in the long direction thereof, when adjacent press-fit contacts are provided in alignment with a line, has a direction of expansion that is not parallel to the line but is angled so as to be rotated about an axis of the center portion at a predetermined angle.

6 Claims, 7 Drawing Sheets

PRESS-FIT CONTACT

BACKGROUND OF THE INVENTION

1. Field of the Invention

The present invention relates to a press-fit contact in which press-fitting into a through-hole of a printed circuit board effects an electrical connection.

2. Related Art

Conventionally, for a connector that is to be mounted on a printed circuit board, contacts for electrical connection to a circuit in the printed circuit board are provided and fixed in place by soldering. However, in recent years, from the viewpoint of solder-free connection or operating efficiency, connectors using press-fit contacts have come to be used.

Such a press-fit contact 10, as shown in FIGS. 7A, 7B, and 7C, is punched out of a sheet of material, and includes an introduction portion 10*a* for introducing the contact 10 into a through-hole 11*a* of a printed circuit board 11, a press-fit portion 10*b*, an expanded portion 10*c*, and a contact portion 10*d*. The press-fit portion 10*b* is formed between the expanded portion 10*c* and the introduction portion 10*a*, and like a sewing needle, configured by arc portions 10*e* projecting along both sides in the shape of an arc so as to form an elliptical slit 10*f* at the center portion as well as form its edge portions. As shown in FIG. 8, the expanded portion 10*c* is fitted and fixed in a fixing hole 12*a* of an insulating housing 12 made of synthetic resin (for example, see JP-A-2005-158507).

Multiple press-fit contacts 10 fitted in the insulating housing 12 are press-fitted into through-holes 11*a* of the printed circuit board 11 respectively. The arc portions 10*e* of the press-fit portions 10*b* of the press-fit contacts 10 are compressed and deformed so that the reaction force causes the arc portions 10*e* to press against the walls of the through-holes 11 and effect a secure electrical connection.

However, in the conventional press-fit contact 10, as shown in FIG. 7C, the press-fit portions 10*b* of adjacent press-fit contacts 10, 10 are arranged in alignment in a direction of expansion of the press-fit portion 10*b* projecting in the shape of an arc. Accordingly, the through-holes 11*a* of the printed circuit board 11 are also arranged in alignment in the same direction. Therefore, when press-fit contacts 10 to be mounted in a high-density manner are arranged with their pitches narrowed, the pitches between the through-holes 11*a* are also brought into close proximity with each other, and as a result, contact pressure in the press-fitting of the press-fit portions 10*b* is generated simultaneously and is concentrated between the through-holes 11*a*, 11*a*, causing strain within the board and causing glass fibers of the board to peel.

SUMMARY OF THE INVENTION

As described above, the printed circuit board 11 is likely to be damaged. Consequently, a press-fit contact according to the present invention is proposed in order to solve the problem of the conventional art described above.

In order to solve the problem described above, a press-fit contact according to the present invention comprises a bulge portion formed wide substantially at a center in a long direction of the press-fit contact, a press-fit portion extending from one end of the bulge portion and projecting in an arc in a width direction of the press-fit contact, a contact portion extending from the other end of the bulge portion, and an introduction portion extending from a distal end of the press-fit portion, wherein a center portion of the press-fit portion in the longitudinal direction thereof, when adjacent press-fit contacts are provided in alignment with a line, having a direction of expansion that is not parallel to the line but is angled so as to be rotated about an axis of the center portion at a predetermined angle.

The angle of the press-fit portion may be formed by twisting the bulge portion, and may also be formed by twisting the press-fit portion itself. In the case of twisting the bulge portion, the formation of a constricted portion with a thinned vertical center makes twisting easy, and is thus preferable. When multiple rows of through-holes are formed vertically and horizontally, it is most preferable that the rotation angle of the press-fit portion be approximately 45 degrees, because doing so gives the spaces between adjacent through-holes their largest values either from the vertical or the horizontal, and will not concentrate contact pressure due to press-fitting of the press-fit portions.

According to the press-fit contact of the present invention, the concentration of contact pressure between the through-holes of the printed circuit board by the press-fit portions of the press-fit contacts is eliminated, thereby enabling damage to the board to be avoided.

In addition, in order to rotate the expansion direction of the press-fit portion, two ways of twisting any of the expanded portion and the press-fit portion itself can be employed, which increases options for the manufacturing method.

Other objects, features and advantages of the present invention will be apparent from the following description when taken in conjunction with the accompanying drawings, in which like reference characters designate the same or similar parts throughout the figures thereof.

DETAILED DESCRIPTION OF THE PREFERRED EMBODIMENTS

A detailed description will now be given of preferred embodiments of the present invention, with reference to the accompanying drawings.

Figure 1A:
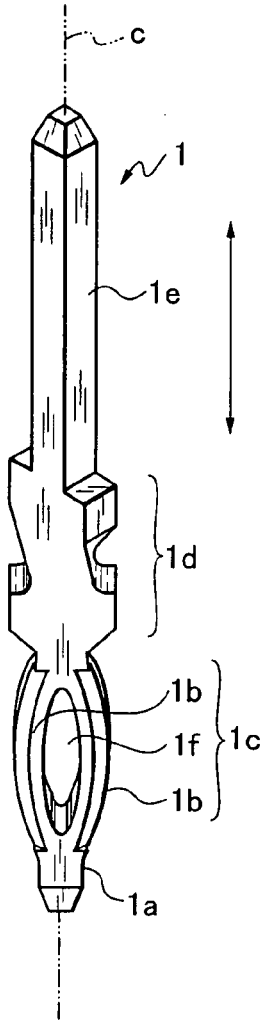
FIG. 1A shows a perspective view of a press-fit contact according to a first embodiment of the present invention.
Figure 1B:
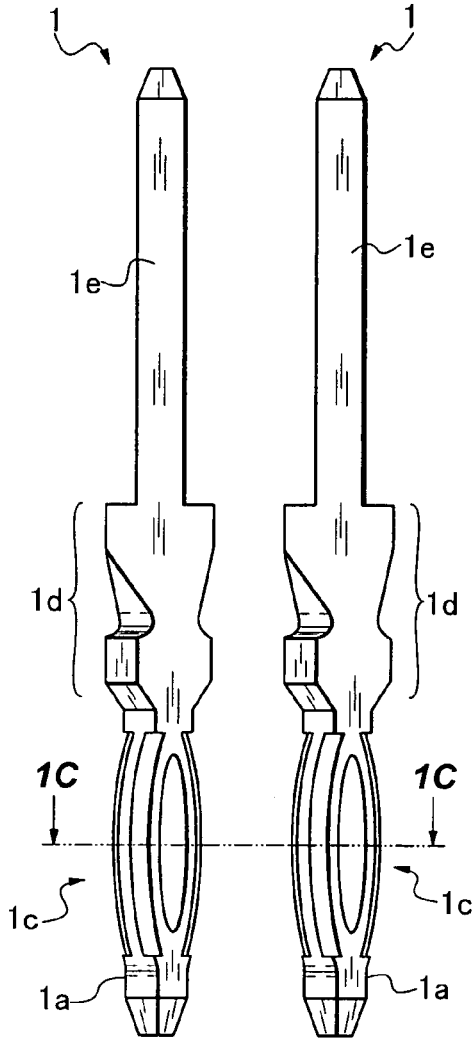
FIG. 1B shows a front view of press-fit contacts according to the first embodiment, which are arranged in a line.
Figure 1C:
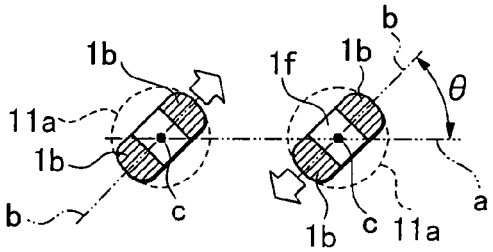
FIG. 1C shows a sectional view along a line 1C-1C in FIG. 1B.
Figure 7A:
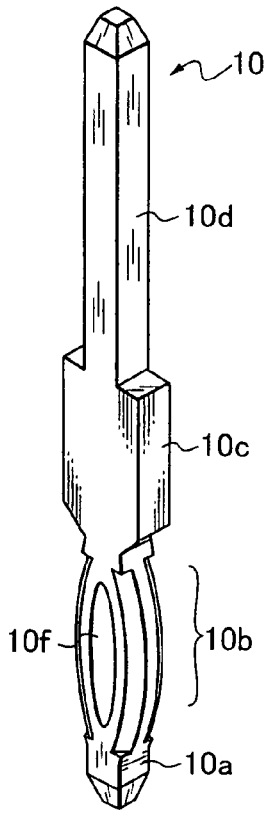
FIG.7A PRIOR ART
FIG. 7A shows a perspective view of a conventional press-fit contact.
Figure 7B:
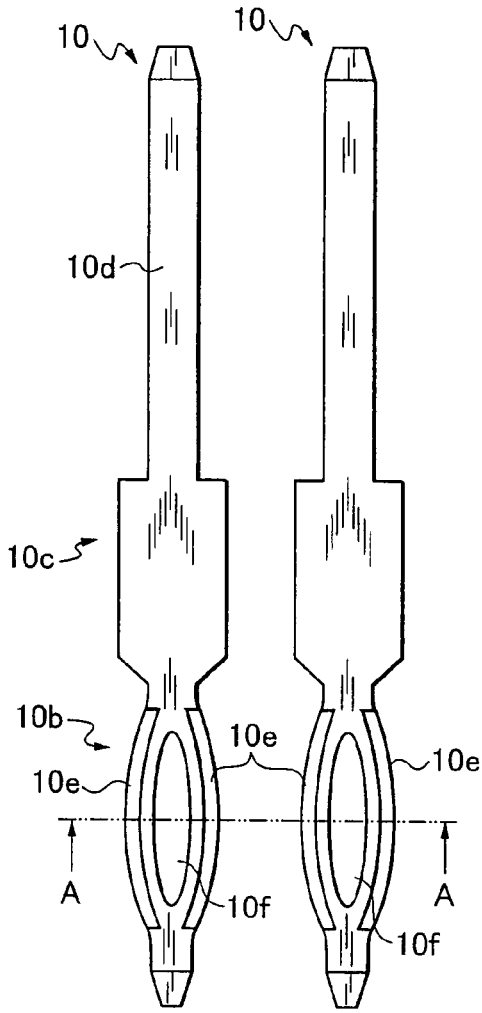
FIG.7B PRIOR ART
FIG. 7B shows a front view of conventional press-fit contacts arranged in a line.
Figure 7C:
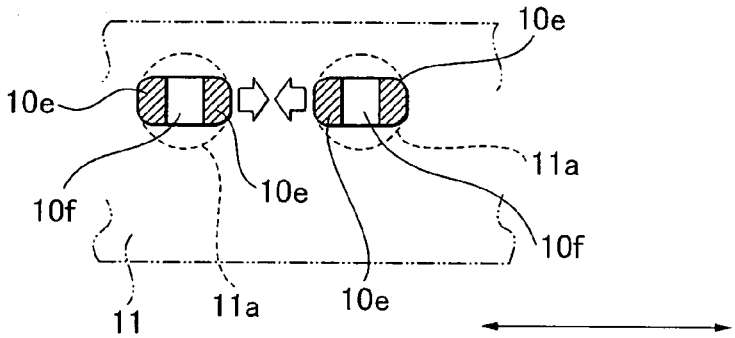
FIG.7C PRIOR ART
FIG. 7C shows a sectional view along a line 7C-7C in FIG. 7B.
Figure 8:
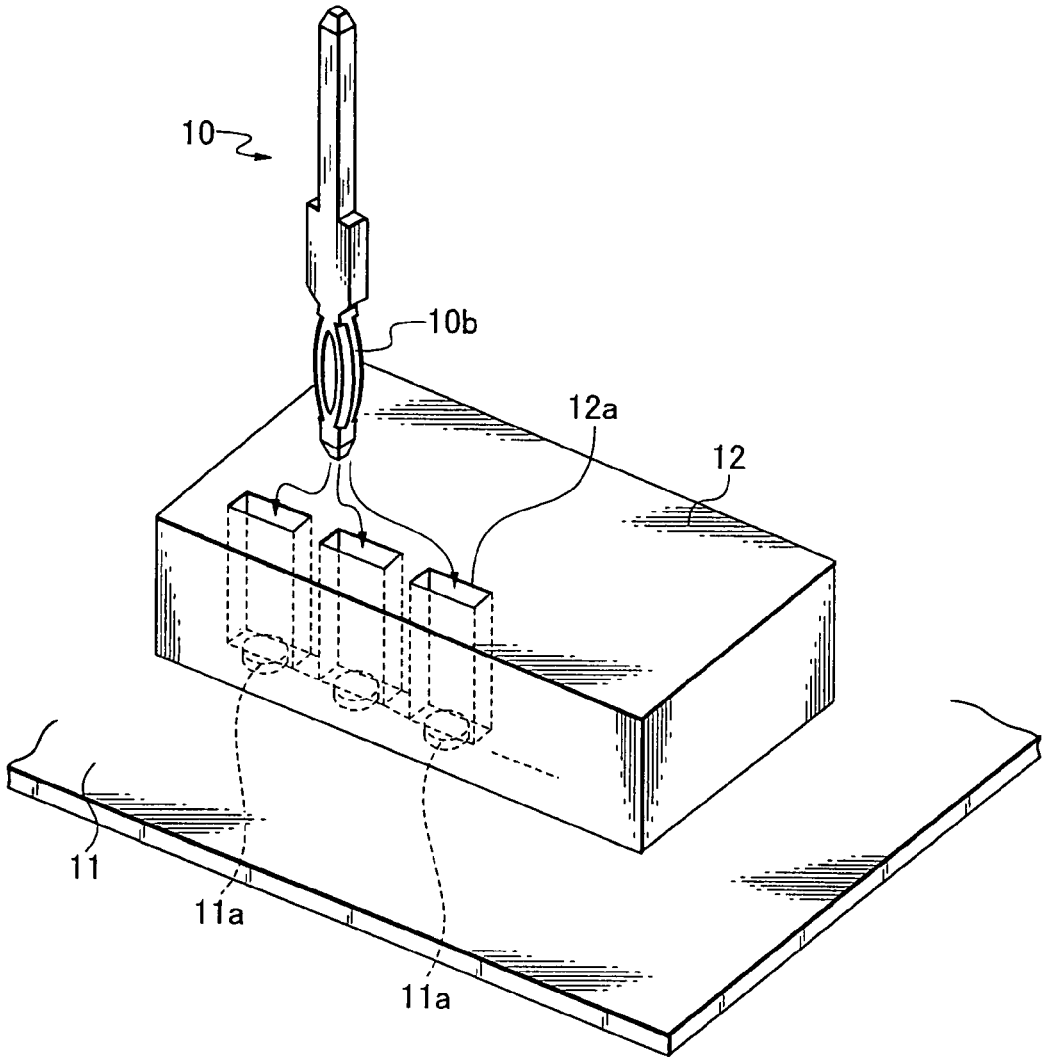
FIG.8 PRIOR ART
FIG. 8 shows a perspective view of the press-fit contact as it is mounted.

FIGS. 1A to 1C show a press-fit contact 1 according to a first embodiment of the present invention, which includes a steeple like introduction portion 1*a* for introducing the contact 1 into the through-hole 11*a* (see FIGS. 7C and 8) of the printed circuit board, a press-fit portion 1*c* adapted to have expanded portions 1*b*, 1*b* projecting along both sides in the shape of an arc while forming an elliptical slit 1*f*, a bulge portion 1*d* extended from the press-fit portion 1*c* and fixed in a fixing hole of an insulating housing, and a contact portion 1*e* extended from the bulge portion 1*d*. The press-fit portion 1*c* is press-fitted into the through-hole 11*a* of the printed circuit board.

The expanded portions 1*b*, 1*b* of the press-fit portion 1*c* projecting in the shape of an arc are twisted around their shaft center "c" in a circumferential direction as shown in FIG. 1C. As a result, when a plurality of press-fit contacts 1 is arranged in parallel in alignment with a line "a", the expanded portions 1*b*, 1*b* of adjacent press-fit portions 1*c* are arranged in parallel with each other so as to be rotated by a twist angle θ with respect to the line "a", such that their direction of expansion "b" is not in alignment with a line. In the present embodiment, the twist angle θ is approximately 45 degrees. In addition, the bulge portion 1*d* is twisted so that the press-fit portion 1*c* is rotated together with the twisted bulge portion 1*d* in plane with the rotation angle θ, and the expansion directions "b" of the expanded portions 1*b*, 1*b* are thus uniform in a longitudinal direction.

Figure 2A:
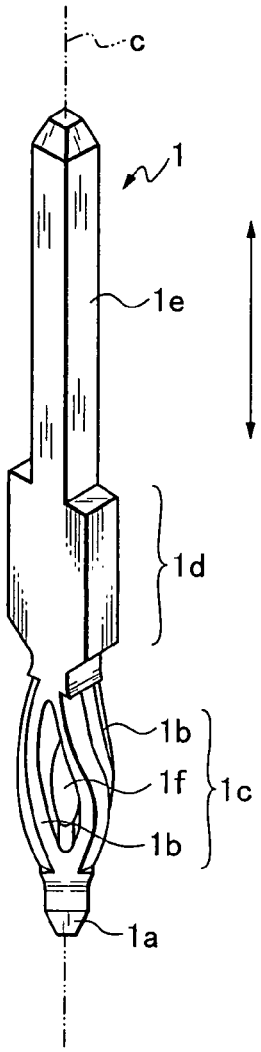
FIG. 2A shows a perspective view of a press-fit contact according to a second embodiment of the present invention.
Figure 2B:
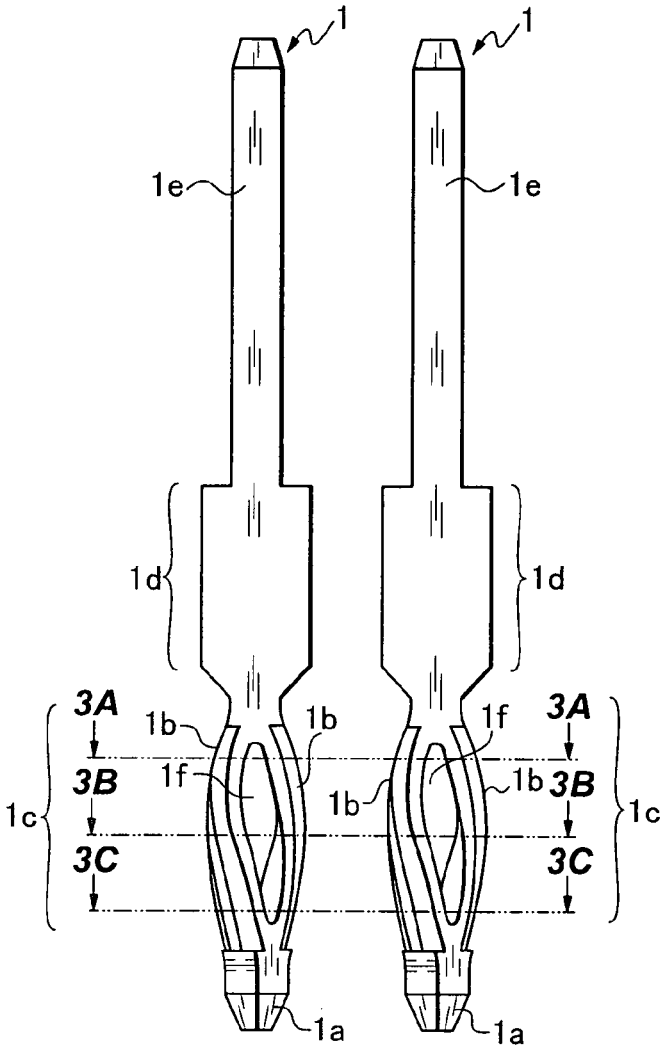
FIG. 2B shows a front view of press-fit contacts according to the second embodiment, which are arranged in a line.
Figure 3A:
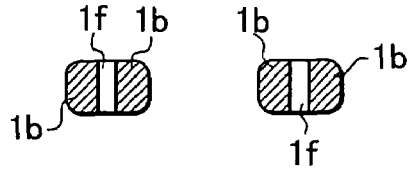
FIGS. 3A to 3C respectively show sectional views along lines 3A-3A, 3B-3B, and 3C-3C in FIG. 2B.
Figure 3B:
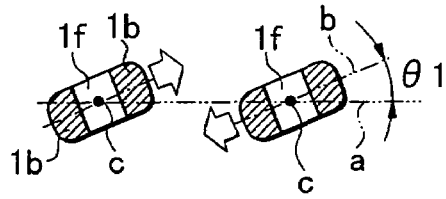
Figure 3C:
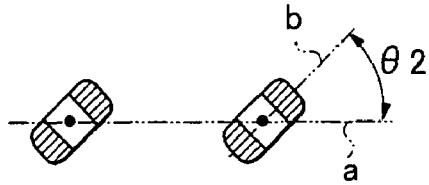

FIGS. 2A and 2B show a press-fit contact 1 according to a second embodiment, where the press-fit portion 1*c* itself is twisted. As shown in FIG. 2B, when three horizontal cross-sections 3A, 3B, and 3C are viewed vertically from the top, the press-fit contact 1 is not yet twisted in the cross-section 3A as shown in FIG. 3A, is rotated by an angle θ1 with respect to a line "a" in the cross-section 3B as shown in 3B, and is rotated by an angle θ2 (θ2>θ1) in the cross-section 3C as shown in 3C. More specifically, the expanded portions 1*b*, 1*b* of the press-fit portion 1*c* are twisted around the shaft center "c" in a circumferential direction to form a spiral shape.

Figure 4:
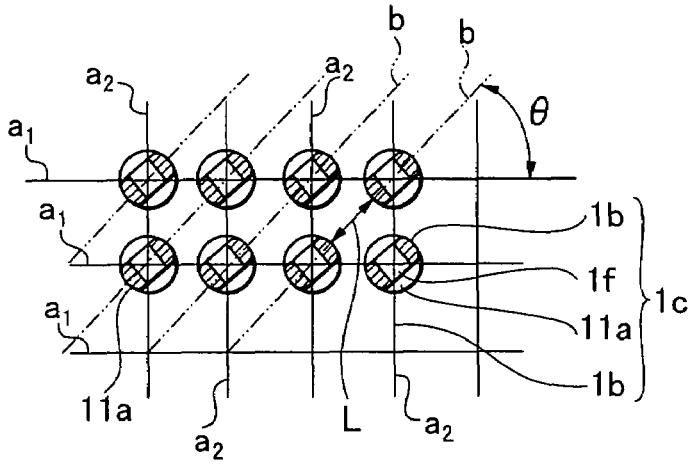
FIG. 4 shows an illustration of arrangement of press-fit contacts according to the present invention for sections of expanded-portions of press-fit portions.

When the press-fit contacts 1 according to the present invention formed as described above are press-fitted into the through-holes 11*a* of the printed circuit board 11, as shown in FIG. 4, the arrangement of the contacts in alignment with a line a1 brings the expansion directions "b" of the expanded portions 1*b*, 1*b* parallel to each other at an angle θ with respect to the line a1. The same applies to a line a2 perpendicular to the line a1. As a result, the concentration of contact pressure due to press-fitting of the press-fit portions 1*c* will not be caused between adjacent through-holes 11*a*, 11*a*.

In addition, when press-fit contacts are disposed in two or more rows, there will be through-holes 11*a*, 11*a* with the expansion directions b, b . . . in alignment as shown in FIG. 4. However, the arrangement of the through-holes 11*a*, 11*a* in the oblique direction makes the distance "L" therebetween substantially longer than the vertical and horizontal arrangement, that is, the arrangement of the expansion directions in alignment with the lines a1 and a2. Thus, the contact pressure is relaxed to eliminate a possibility of generation of damage to the board.

Figure 5:
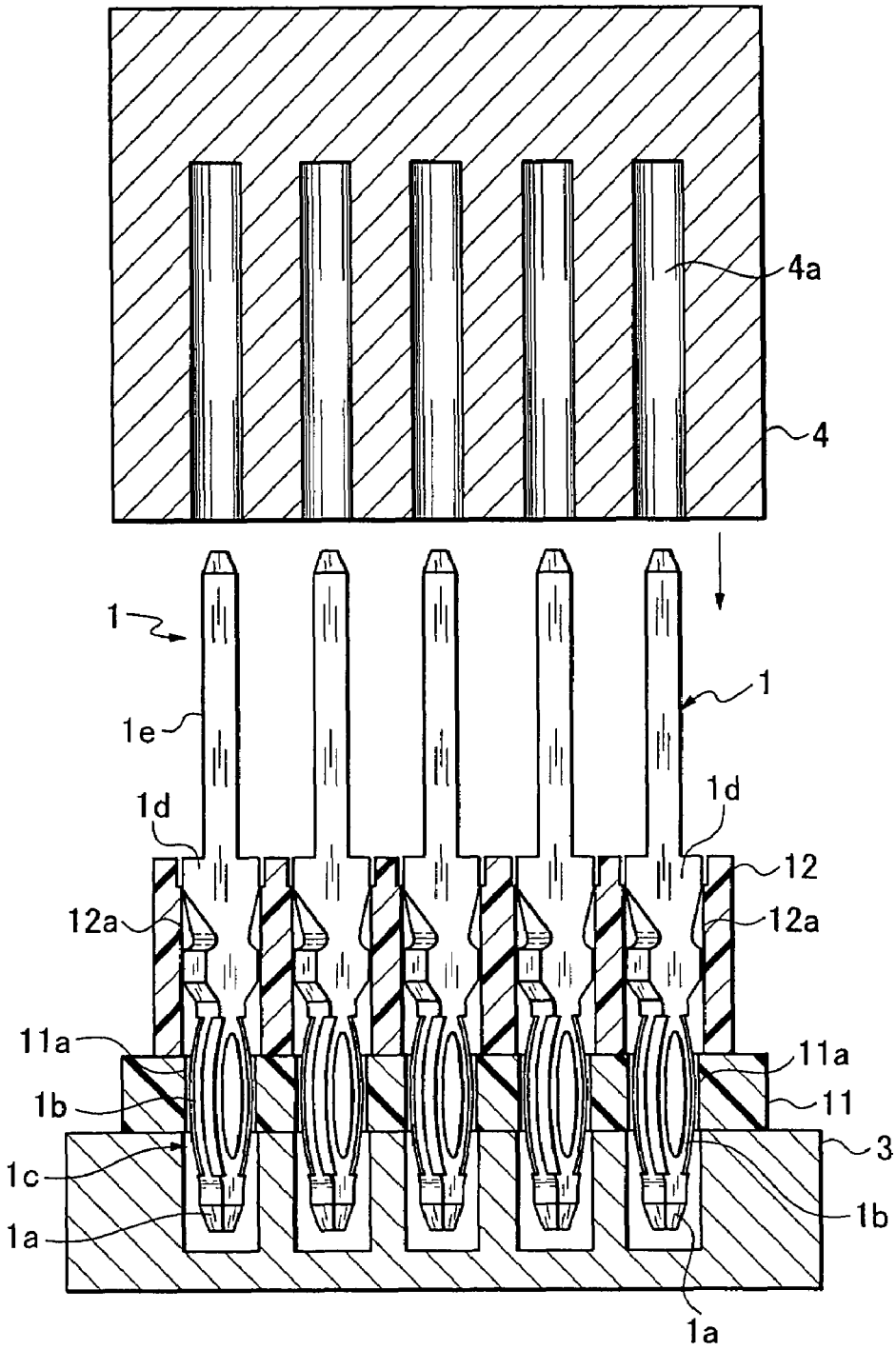
FIG. 5 shows a sectional view for a method of mounting press-fit contacts according to the present invention into through-holes of a printed circuit board with use of a jig.
Figure 6:
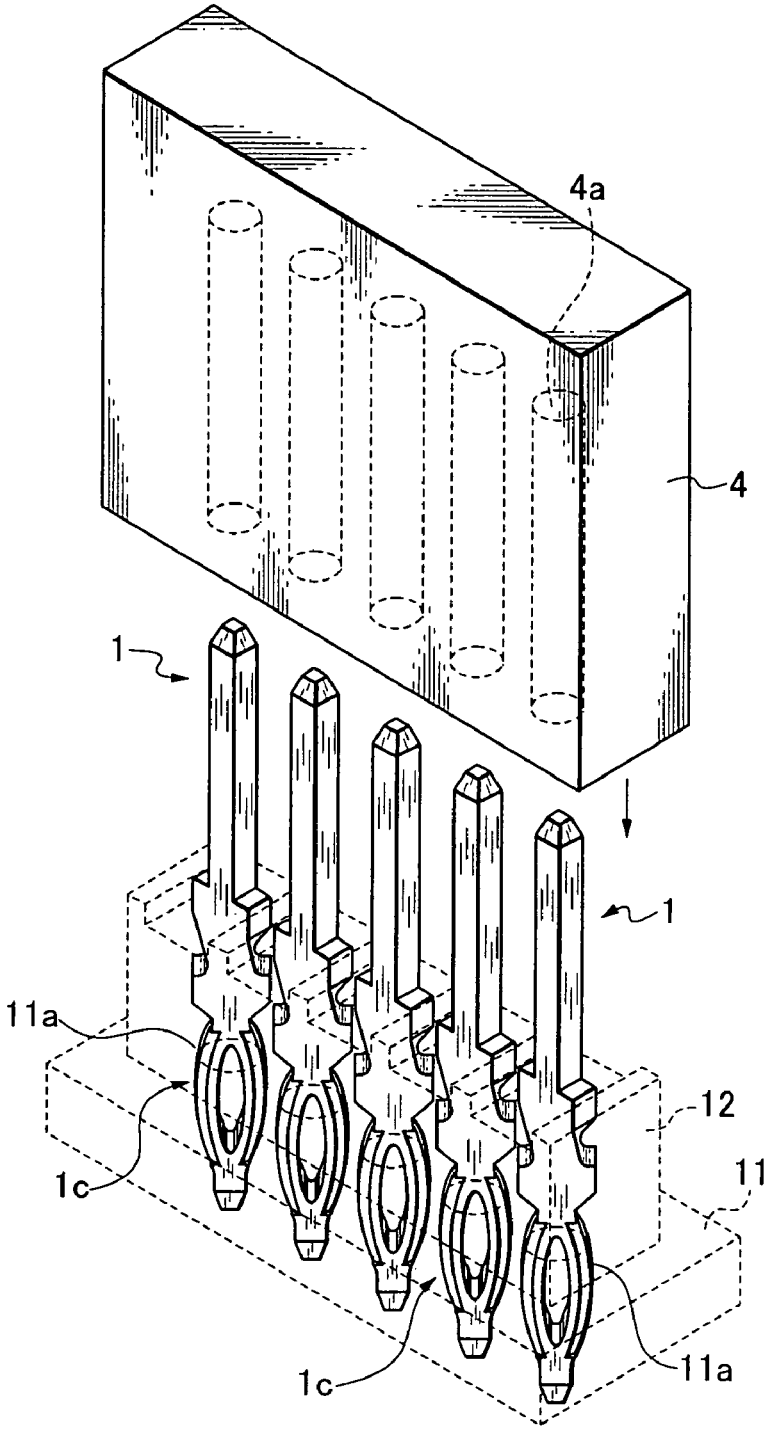
FIG. 6 shows a perspective view for the mounting method of the press-fit contacts.

In order to press-fit the press-fit contacts 1 according to the present invention into a printed circuit board 11, as shown in FIGS. 5 and 6, the printed circuit board 11 and an insulating housing 12 are placed on a receiving jig 3, the press-fit contacts 1 are inserted into each of a plurality of fixing holes 12*a*, and a driving jig 4 with escape holes 4*a*, with each contact portion 1*e* put in an escape hole 4*a*, is placed on the press-fit contact 1 and pressed downward, causing the introduction portions 1*a* of the press-fit contacts 1 to pass through the through-holes 11*a* so to project downwardly, and the bulge portions 1*d* are thus press-fitted and fixed in the fixing holes 12*a* with the expanded portions 1*b*, 1*b* of the press-fit portions 1*c* strongly contacted against the walls of the through-holes 11*a*.

As many apparently widely different embodiments and variations of the present invention can be made without departing from the spirit and scope thereof, it is to be understood that the invention is not limited to the specific embodiments thereof and described herein, except as defined in the appended claims.

What is claimed is:

1. A press-fit contact comprising:

a bulge portion formed wide substantially at a center in a long direction of the press-fit contact, a press-fit portion extending from a first end of the bulge portion and projecting in an arc in a width direction of the press-fit contact, a contact portion extending from a second end of the bulge portion, and an introduction portion extending from a distal end of the press-fit portion, wherein a center portion of the press-fit portion in the long direction thereof, when adjacent press-fit contacts are provided in alignment with a line, has a direction of expansion that is not parallel to the line but is angled so as to be rotated about an axis of the center portion at a predetermined angle, and wherein the angle of the press-fit portion is formed by the bulge portion being a twisted bulge portion.

2. The press-fit contact according to claim 1, wherein the bulge portion is made by forming a constricted portion with a thinned vertical center and the constricted portion being a twisted constricted portion.

3. The press-fit contact according to claim 1, wherein the angle of rotation of the press-fit contact is approximately 45 degrees.

4. The press-fit contact according to claim 2, wherein the angle of rotation of the press-fit contact is approximately 45 degrees.

5. A press-fit contact comprising:

a bulge portion formed wide substantially at a center in a long direction of the press-fit contact, a press-fit portion extending from a first end of the bulge portion and projecting in an arc in a width direction of the press-fit contact, a contact portion extending from a second end of the bulge portion, and an introduction portion extending from a distal end of the press-fit portion, wherein a center portion of the press-fit portion in the long direction thereof, when adjacent press-fit contacts are provided in alignment with a line, has a direction of expansion that is not parallel to the line but is angled so as to be rotated about an axis of the center portion at a predetermined angle, and wherein the angle of the press-fit portion is formed by the press-fit portion being a twisted press-fit portion.

6. The press-fit contact according to claim 5, wherein the angle of rotation of the press-fit contact is approximately 45 degrees.

* * * * *